US009373901B2

(12) United States Patent
Singer et al.

(10) Patent No.: US 9,373,901 B2
(45) Date of Patent: Jun. 21, 2016

(54) SPRING CLIP FOR SHIELDING OF ELECTRICAL CONNECTORS

(71) Applicant: ITT MANUFACTURING ENTERPRISES LLC, Wilmington, DE (US)

(72) Inventors: Helmut Singer, Bad Ditzenbach (DE); Martin Littek, Kernen (DE); Andreas Standfest, Schorndorf (DE)

(73) Assignee: ITT Manufacturing Enterprises, LLC, Wilmington, DE (US)

( * ) Notice: Subject to any disclaimer, the term of this patent is extended or adjusted under 35 U.S.C. 154(b) by 0 days.

(21) Appl. No.: 14/722,660

(22) Filed: May 27, 2015

(65) Prior Publication Data

US 2015/0349468 A1 Dec. 3, 2015

(30) Foreign Application Priority Data

May 28, 2014 (DE) ..... 10 2014 210 254

(51) Int. Cl.

| | |
|---|---|
| ***H01R 13/17*** | (2006.01) |
| ***H01R 4/48*** | (2006.01) |
| ***H01R 13/18*** | (2006.01) |
| ***H01R 13/6583*** | (2011.01) |

(52) U.S. Cl.
CPC ..... *H01R 4/4881* (2013.01); *H01R 13/18* (2013.01); *H01R 13/6583* (2013.01)

(58) Field of Classification Search
CPC ... H01R 4/4881; H01R 13/6583; H01R 13/18
USPC ..... 439/607.19, 108, 557, 827, 607.17, 439/607.18, 843; 174/355
See application file for complete search history.

(56) References Cited

U.S. PATENT DOCUMENTS 3,678,445 A * 7/1972 Brancaleone .... H01R 13/65802 439/607.17
4,082,411 A * 4/1978 Storck ..... H01R 13/17 439/827
4,120,557 A * 10/1978 Horrocks ..... H01R 13/15 439/827

(Continued)

FOREIGN PATENT DOCUMENTS

DE 8630393 1/1987
DE 102012219509 5/2013

(Continued)

OTHER PUBLICATIONS

European Search Report mailed Sep. 23, 2015 for European Application No. 15165151.0, including partial translation.

(Continued)

*Primary Examiner* — Abdullah Riyami
*Assistant Examiner* — Nelson R Burgos-Guntin
(74) *Attorney, Agent, or Firm* — RatnerPrestia

(57) ABSTRACT

Grounding finger for shielding at an electrical connection between a plug connector and a mating plug connector of an electrical line, having a sleeve-like support element which has a first outer edge and a second outer edge, axial connecting webs being provided between the outer edges, and having a plurality of spring limbs which act radially outward and, at least at one end, are connected to one of the edges in order to generate a spring-loaded contact force to the outer plug connector, with some of the connecting webs being interrupted and being formed in each case with at least one contact lug which faces radially inward.

9 Claims, 2 Drawing Sheets

(56) References Cited

U.S. PATENT DOCUMENTS 4,128,293 A * 12/1978 Paoli ..... H01R 13/187 439/827
4,423,919 A * 1/1984 Hillis ..... H01R 13/65802 439/607.17
4,655,533 A * 4/1987 Haag ..... H01R 13/6583 29/520
4,874,337 A * 10/1989 Paukovits, Jr. ... H01R 13/65802 29/876
4,936,795 A * 6/1990 Kawai ..... H01R 13/655 439/607.19
5,041,022 A * 8/1991 Sekiguchi ..... H01R 13/627 439/353
5,653,615 A * 8/1997 Inaba ..... H01R 13/17 439/827
5,893,782 A * 4/1999 Harting ..... H01R 13/17 439/265
5,998,737 A * 12/1999 Weiss ..... F16L 3/08 174/135
6,590,478 B2 * 7/2003 Pluymers ..... H01P 1/047 333/246
7,488,905 B2 * 2/2009 Kiely ..... H01R 13/745 174/650
8,920,192 B2 * 12/2014 Montena ..... H01R 9/05 439/320
2006/0157273 A1 * 7/2006 White ..... H05K 9/0016 174/354
2007/0012478 A1 * 1/2007 Nasstrom ..... H01R 4/64 174/354
2008/0047745 A1 * 2/2008 Smeltz ..... H05K 9/0016 174/355
2014/0357137 A1 * 12/2014 Sian ..... H01R 13/187 439/843
2015/0349468 A1 * 12/2015 Singer ..... H01R 4/4881 439/607.19

FOREIGN PATENT DOCUMENTS

| | | |
|---|---|---|
| FR | 2499323 | 8/1982 |
| GB | 2066591 | 7/1981 |
| WO | 2013060756 | 5/2013 |

OTHER PUBLICATIONS

German Examination Report mailed Feb. 2, 2015 for German Application No. 10 2014 210 254.5.

* cited by examiner

SPRING CLIP FOR SHIELDING OF ELECTRICAL CONNECTORS

CROSS-REFERENCE TO RELATED APPLICATION

This application claims priority to German Patent Application No. 10 2014 210 254.5, filed May 28, 2014, which is incorporated by reference herein in its entirety.

FIELD OF THE INVENTION

The present invention relates to shielding of electrical plug connectors, more precisely to a grounding finger for such shielding of plug connectors in electrical lines.

BACKGROUND OF THE INVENTION

In order to ensure continuous shielding of electrical lines across the plug connectors too, it is necessary for an element which shields against interference signals from the electrical line or from outside the electrical line to be provided at the position of the plug connectors and mating plug connectors. By way of example, so-called grounding fingers, which establish a releasable connection but allow secure continuous shielding of the line in the closed state, are inserted between the plugs and mating plugs for this purpose in the case of plug connections with bayonet fitting-type locking means. This situation is also described by the term 'shielding contact-connection'. In this way, interference signals from the outside in particular, but also interference signals from the electrical line itself, should be prevented from passing through at the interface of the plugs.

The grounding fingers, which are known from the prior art, of plug connections of this kind for shielding electrical connecting elements generally have a sleeve-like component with a plurality of spring elements distributed over the outer circumference. The spring elements establish a connection between the inner plug connector and the outer mating plug connector, and in this way produce shielding contact-connection. In the process, good contact between the spring elements and the respective plug connectors is necessary so that efficient shielding is ensured. WO 2013/060756 A1, which is incorporated by reference herein, discloses, for example, a shielding contact spring of this kind for an electrical plug connection in which the shielding contact spring has a first and a second outer edge in the form of a sleeve-like element, spring elements which project outward and connecting webs being provided between said outer edges. When the plug connection is in the assembled state, the shielding contact springs therefore ensure a continuous transition with a very low level of resistance as far as possible, so that shielding against, for example, electrical or electromagnetic interference signals is ensured. However, it has been found in some applications that a grounding finger of this kind or a shielding contact spring of this kind does not ensure sufficient contact with the two elements of the plug connection, the inner plug connector and the outer mating plug connector. Increased resistances at the transition points in the plug connection may occur if the spring elements and the sleeve-like grounding finger do not bear sufficiently firmly against the two plug connector elements. This has an adverse effect on the effectiveness of the shielding and leads to undesired interference signals.

SUMMARY OF THE INVENTION

Against this background, described herein is a grounding finger for highly efficient shielding of plug connections of this kind, with which grounding finger the mutual contact between the grounding finger and the elements of the plug connection is further improved and transfer resistances which are as low as possible are produced in every situation.

According to the present invention, a grounding finger for shielding at an electrical connection between a plug connector and a mating plug connector of an electrical line, having a sleeve-like support element is provided, which grounding finger has a first outer edge and a second outer edge, axial connecting webs in relation to the longitudinal axis of the plug connection being provided between said outer edges, and also has a plurality of spring limbs or spring elements which act radially outward and, at least at one end, are connected to one of the edges in order to generate a spring-loaded contact force to the outer element of the plug connection. The grounding finger according to aspects of the invention is distinguished in that some of the connecting webs are interrupted and are formed in each case with at least one contact lug which faces radially inward. The connecting webs, which are provided, for example, in each case alternately with the spring limbs over the circumference of the grounding finger, establish a connection between the first and second outer edges, so that the grounding finger has a rectangular shape which is substantially closed to the outside. According to aspects of the invention, at least some of the connecting webs are interrupted and are formed in each case with at least one additional contact lug, which extends radially inward from the grounding finger in the direction of the inner plug connector element, at the point of the interruption. While the spring limbs provide an outwardly acting contact force on the corresponding element of the plug connection, increased contact forces are also generated on the inside against the inner element of the plug connection by the additional contact lugs according to aspects of the invention which are directed inward from the plug connection. The inwardly directed contact lugs specifically increase the pressure against the inner element of the plug connection, so that production of transfer resistances is largely avoided at this point too. The grounding finger, which is usually inserted into an accommodation groove, therefore bears securely against the two elements of the plug connection with a kind of pretensioning force. There are therefore considerably lower transfer resistances in the shielding at the interface between the plug connector and the mating plug connector in comparison to conventional grounding fingers of this kind for electrical plug connections. Nevertheless, the grounding finger according to aspects of the invention is considered to be comparatively simple in terms of its structural configuration and can be easily produced with a correspondingly reduced level of expenditure. Furthermore, no additional elements or components are required in order to realize a secure contact transition at the shielding of the plug connection.

According to an advantageous refinement of the invention, the interrupted connecting webs of the grounding finger are separated approximately in the center, and in each case two axially opposite contact lugs are provided in an approximately central region of the support element, in each case in a symmetrical manner. That is to say, the non-continuous connecting webs, which are provided with an aperture in their central section by means of punching for example, are formed with in each case two opposite contact lugs which protrude radially inward and which, in the fitted state, bear and are pressed firmly against the inner element of the plug connection. In this way, the contact-connection of the shielding is further optimized since in each case two contact lugs are provided at the respective points of the interrupted connecting webs. Contact of the grounding finger between the two elements of the plug connection, specifically the plug connector and a mating plug connector, is also improved as a result since unintentional or undesired inclined installation and a change in position are reliably avoided as a result.

According to a further advantageous refinement of the invention, the contact lugs of the grounding finger are formed approximately at right angles to the support element. The support element extends in a longitudinal direction of the plug connection, whereas the contact lugs themselves extend approximately at right angles to said longitudinal direction, that is to say protrude inwardly directly to the bottom of the groove in order to be fastened to the plug connector. The contact lugs are therefore formed in the manner of a hook-like end section from amongst the sections of the remainder of the connecting webs which have been interrupted in order to increase the contact forces in an optimum manner as per the invention. A force with which the contact lugs bear against the internal element of the plug connection is further increased in this way, and reliable and effective shielding is ensured in every situation in which the plug connection is used.

According to a further advantageous refinement of the grounding finger according to aspects of the invention, connecting webs and spring limbs are provided alternately in each case in a manner distributed over the circumference of the support element, and each fourth connecting web is interrupted and formed with at least one, preferably with two contact lugs. In this way, a sufficient number of contact lugs are formed on the radially inner side of the grounding finger in a manner distributed uniformly over the circumference, without the stability and strength of the grounding finger being adversely affected overall. The remaining connecting webs provide a sufficient degree of robustness for the grounding finger, and therefore damage or deformation can be reliably avoided. Investigations by the inventors have shown that considerably lower transfer resistances are achieved at the transition between the elements of the plug connection using a grounding finger of this kind, and nevertheless highly efficient shielding against interference signals from the outside and also from the inside by the electrical line is provided.

According to a further advantageous refinement of the grounding finger according to aspects of the invention, the spring limbs protrude from one of the edges of the support element essentially in a manner bent in the shape of an S. It goes without saying that the spring elements can also be fastened to both edges of the support element in each case or can be formed, for example, so as to protrude alternately from one of the edges or from the other of the edges. Forming a spring limb which is bent in the shape of an S in this way produces a comparatively large contact area of the spring limbs. Furthermore, a sufficiently high spring force is produced by spring limbs of this kind which are bent in the shape of an S. In addition, release and connection of the plug connection is largely unhindered in this way since the free ends of the spring limbs are in each case again angled or bent in the direction of the longitudinal axis of the plug connection or of the grounding finger itself. It is therefore possible to connect and release the plug connection without friction.

According to a further advantageous refinement of the grounding finger according to aspects of the invention, the sleeve-like support element has a slot and is produced from a spring-elastic sheet-metal material. The slot runs in an axial direction of the grounding finger, so that a kind of ring which is open on one side is formed. As a result, the grounding finger itself can be formed in such a way that it already bears against a plug element of the electrical plug connection with slight pretension in a corresponding accommodation groove. In addition, insertion and fitting of the grounding finger is made easier as a result. Owing to the improved contact connection between the grounding finger and the two adjoining plug connector elements, the transfer resistances are further reduced without having an adverse effect on the shielding action.

According to a further advantageous refinement of the grounding finger according to aspects of the invention, the spring limbs are in the form of spring elements which are free on three sides. That is to say, each spring limb is connected to one of the edges at its lower end, and is not connected to the support element or to the adjoining connecting webs at its lateral sides and at the free end. This produces a kind of leaf spring as the spring limb, said leaf spring ensuring a high spring force without excessively hindering connection and opening of the plug connection. In spite of this, shielding is provided approximately continuously over the entire surface of the grounding finger. It is also comparatively easy to produce a grounding finger of this kind since the grounding finger can be produced from, for example, a flat, rectangular sheet-metal part using simple punching and bending methods.

According to a further refinement of the grounding finger according to aspects of the invention, the spring limbs have, at their free end, a slightly rounded shape approximately parallel to the axial direction of the support element. Frictional resistance when connecting and releasing the plug connection on the grounding finger and the outer element of the plug connection is further reduced in this way. The free ends of the grounding finger can easily slide along the corresponding inner wall of the plug connection without getting caught and, nevertheless, provide a sufficient firm contact in the closed state, this producing very low transfer resistances of the shielding.

According to a further advantageous refinement of the grounding finger according to aspects of the invention, said grounding finger is produced from a spring-elastic sheet-metal material by punching and bending. The grounding finger is produced, for example, from a flat, rectangular sheet-metal element in which the spring limbs and interspaces are punched out between the connecting webs. Furthermore, the interrupted connecting webs are formed by severing some of the webs, and then the inwardly projecting contact lugs and the outwardly facing spring limbs are bent into their respectively defined shape. After these steps, the flat element is, for example, bent into the annular shape of the grounding finger in accordance with the diameter of the plug connection or its accommodation groove, wherein a slot remains at the free ends of the grounding finger. In this way, the grounding finger according to aspects of the invention can be produced with very little expenditure using comparatively simple means and without relatively large modifications to existing machine tools.

BRIEF DESCRIPTION OF THE DRAWINGS

An exemplary embodiment of a grounding finger according to aspects of the invention will be explained in greater detail below with reference to the appended drawing, in which.

DETAILED DESCRIPTION OF THE INVENTION

Figure 1:
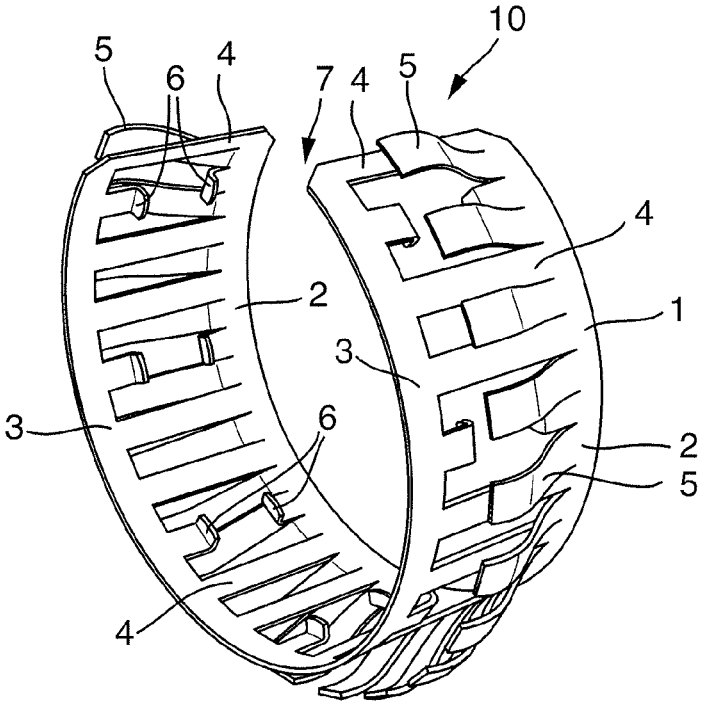
FIG. 1 shows a perspective view of an exemplary embodiment of a grounding finger according to aspects of the invention for shielding.
Figure 2:
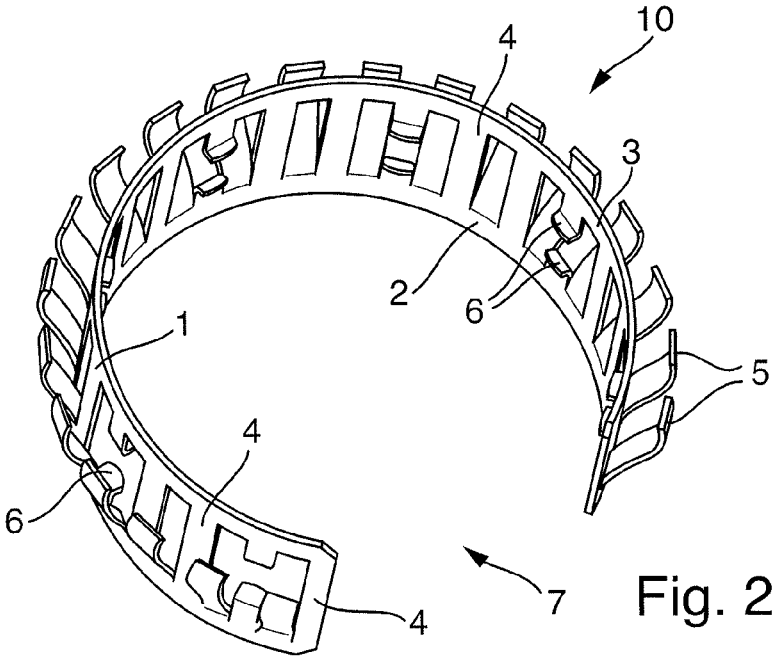
FIG. 2 shows a further perspective view of the exemplary embodiment of a grounding finger according to aspects of the invention.
Figure 3:
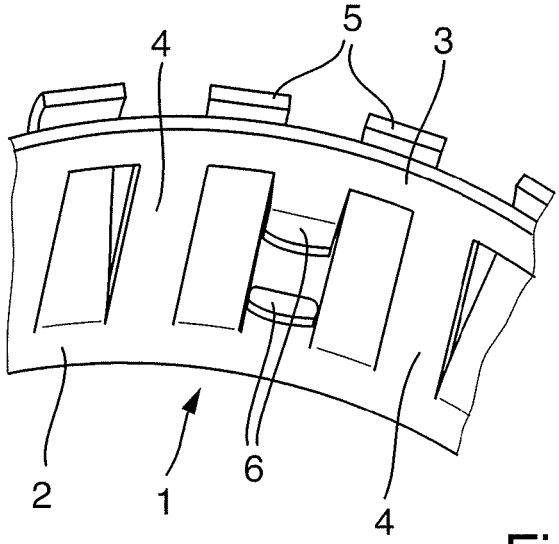
FIG. 3 shows a perspective view of a detail of the exemplary embodiment of a grounding finger according to aspects of the invention.
Figure 4:
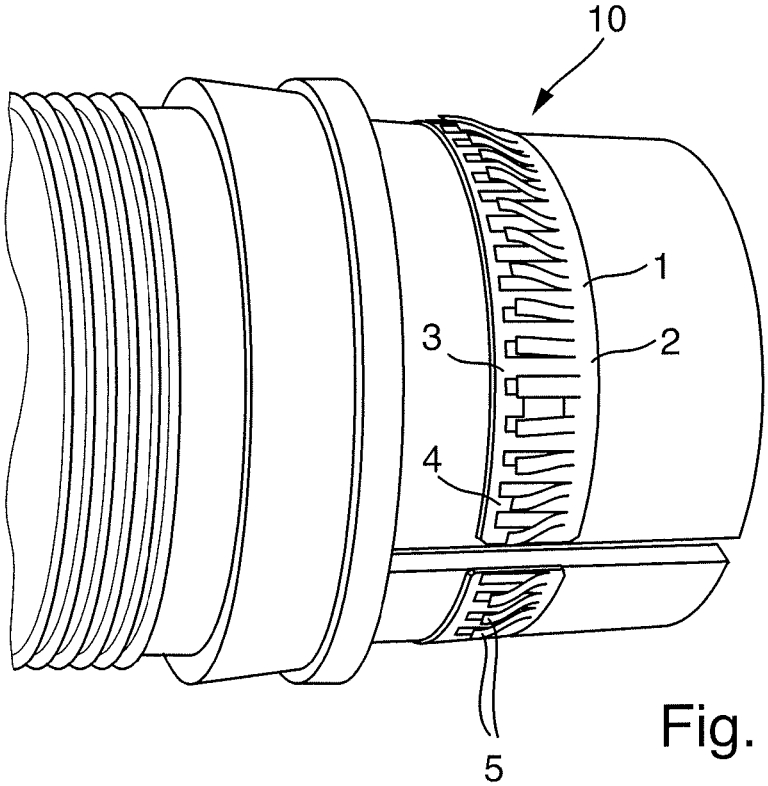
FIG. 4 shows a side view of the grounding finger according to aspects of the invention in its intended location on an inner plug connector of the shielded plug connection.

FIGS. 1 to 4 show an exemplary embodiment of a grounding finger for shielding an electrical plug connection according to aspects of the invention. The grounding finger 10 in this case has a ring shape which is open on one side and comprises a sleeve-like support element 1 which is provided with a slot 7 on one side. The support element 1 has a first outer edge 2 and also a second outer edge 3 which is situated opposite said first outer edge. The edges 2, 3 are firmly connected to one another by means of connecting webs 4. The sleeve-like support element 1 in this case has an approximately rectangular shape which is bent into the annular shape, which is opened by means of a slot 7, in accordance with a predefined diameter. In the exemplary embodiment which is shown in the figures, connecting webs 4 and outwardly protruding spring limbs 5 are provided alternately in each case. The spring limbs 5 are produced from the originally flat, rectangular support element 1 by means of punching and bending. In this exemplary embodiment, the outwardly protruding spring limbs 5 are bent into an approximate S shape, so that the section at the free ends again runs substantially parallel to the axial longitudinal direction of the support element 1. In the fitted state, the spring limbs 5 press against an outer plug connector (not shown in the figures) of the electrical plug connection in order to establish secure contact between the elements of the plug connection at the interface of said elements. Therefore, the grounding finger 10 can produce effective shielding at the interface of the plug connection, so that no electrical or electromagnetic interference signals can start from the electrical line or be introduced into the electrical line in the case of, for example, an electrical line for sensors or the like.

According to the present invention, there is an aperture in some of the connecting webs 4, inwardly projecting additional contact lugs 6 being formed at said aperture. In the exemplary embodiment which is shown in the figures, each fourth connecting web 4 is interrupted or severed in the center, and in each case two opposite contact lugs 6 are formed at the ends of the remaining portion of the connecting webs 4. The contact lugs 6 are formed at a right angle in relation to the longitudinal direction of the support element 1. When the grounding finger 10 is mounted in its intended position, for example in a groove in a plug connector (cf. FIG. 4), the contact lugs 6 press against the bottom of the accommodation groove in the plug connector, and therefore relatively high contact forces to the inner plug connector are produced. In the case of the grounding finger according to aspects of the invention, this results in considerably lower transfer resistances in comparison to conventional grounding fingers of this kind of shielding of plug connections of this kind. In this way, reliable contact is established at the transition point between the plug connector and the mating plug connector in every installation situation and even in the event of unintended movement on the cable of the electrical line. The effectiveness of shielding is therefore considerably improved.

The grounding finger according to the present invention can be used, for example, in so-called plug connections of the bayonet type and in this case results in a considerable reduction in the transfer resistances in comparison to a conventional grounding finger which does not have any inwardly protruding contact lugs (cf. above-described prior art). In the exemplary embodiment shown in this case, the spring limbs 5 are free on three sides and are connected to the support element 1 only at the outer edge 2. However, said spring limbs can also be connected to both edges 2, 3 as an alternative. The spring limbs 5 can have a shape other than the S shape which is bent twice. The contact lugs 6 are not restricted to the shown exemplary embodiment either. For example, instead of every fourth connecting web 4 being interrupted, it is possible for only every fifth or sixth connecting web to be interrupted and to be formed with contact lugs 6. It is also feasible for every second or third connecting web to be provided with an interrupted section at which the additional contact lugs 6 are formed. The contact lugs can in each case be provided as two contact lugs which are arranged on an opposite side or else only as a single contact lug 6 which is present on one side of the aperture. The contact lugs 6 can also be bent at an incline in relation to the axial direction of the support element 1, instead of being bent substantially at a right angle.

The grounding finger according to aspects of the invention with relatively high contact forces can additionally be produced in a very simple manner. Simple punching processes and bending operations are well suited to producing the spring limbs 5 and the contact lugs 6. According to a preferred refinement, the grounding finger 10 is produced from a spring-elastic metal material starting from a flat, rectangular precursor. All metal materials or non-metal materials which provide an electrical line for shielding a plug connection are suitable for producing the grounding finger.

What is claimed is:

1. A grounding finger for shielding at an electrical connection between a plug connector and a mating outer plug connector of an electrical line, having a sleeve-like support element which has a first outer edge and a second outer edge, axial connecting webs being provided between said outer edges, and having a plurality of spring limbs which act radially outward and, at least at one end, are connected to one of the edges in order to generate a spring-loaded contact force to the outer plug connector, wherein some of the connecting webs are interrupted and are formed in each case with at least one contact lug which faces radially inward.

2. The grounding finger as claimed in claim 1, wherein the interrupted connecting webs are separated approximately in the center, and wherein in each case two axially opposite contact lugs are provided in a central region of the support element.

3. The grounding finger as claimed in claim 2, wherein the contact lugs are formed approximately at right angles to the support element.

4. The grounding finger as claimed in claim 1, wherein connecting webs and spring limbs are provided alternately in each case, and wherein each fourth connecting web is interrupted and formed with contact lugs.

5. The grounding finger as claimed in claim 1, wherein the spring limbs protrude from one of the edges of the support element in a manner bent in the shape of an S.

6. The grounding finger as claimed in claim 1, wherein the sleeve-like support element has a slot and is produced from a spring-elastic sheet-metal material.

7. The grounding finger as claimed in claim 1, wherein the spring limbs are spring elements which are free on three sides.

8. The grounding finger as claimed in claim 1, wherein the spring limbs have, at their free end, a slightly rounded shape approximately parallel to an axial direction of the support element.

9. The grounding finger as claimed in claim 1, wherein the grounding finger is produced from a spring-elastic sheet-metal material by punching and bending.

* * * * *